US009401558B1

(12) United States Patent
Yu et al.

(10) Patent No.: US 9,401,558 B1
(45) Date of Patent: Jul. 26, 2016

(54) POWER CONNECTOR

(71) Applicant: ALLTOP ELECTRONICS (SUZHOU) LTD., Taicang, JiangSu Province (CN)

(72) Inventors: Wang-I Yu, Jhonghe (TW); Yung-Chih Hung, Jhonghe (TW); I-Hung Cheng, Jhonghe (TW)

(73) Assignee: ALLTOP ELECTRONICS (SUZHOU) LTD., Taicang (CN)

( * ) Notice: Subject to any disclaimer, the term of this patent is extended or adjusted under 35 U.S.C. 154(b) by 0 days.

(21) Appl. No.: 14/818,602

(22) Filed: Aug. 5, 2015

(30) Foreign Application Priority Data

Jan. 30, 2015 (CN) ..... 2015 1 0051734
Jun. 2, 2015 (CN) ..... 2015 1 0296351

(51) Int. Cl.
*H01R 13/42* (2006.01)
*H01R 4/02* (2006.01)
*H01R 12/70* (2011.01)

(52) U.S. Cl.
CPC ..... *H01R 13/42* (2013.01); *H01R 4/02* (2013.01); *H01R 12/7088* (2013.01)

(58) Field of Classification Search
CPC ..... H01R 4/02; H01R 13/42; H01R 12/7088
See application file for complete search history.

(56) References Cited

U.S. PATENT DOCUMENTS 6,224,430 B1 * 5/2001 Kusuda ..... H01R 12/515 439/709
6,319,075 B1 * 11/2001 Clark ..... H01R 13/11 439/65
6,394,818 B1 * 5/2002 Smalley, Jr. ..... H01R 12/7088 439/181
6,604,967 B2 * 8/2003 Middlehurst ..... H01R 13/113 439/862
6,780,027 B2 * 8/2004 Allison ..... H01R 12/727 439/507
6,814,590 B2 * 11/2004 Minich ..... H01R 12/727 439/79
6,848,950 B2 * 2/2005 Allison ..... H01R 12/75 439/682
6,848,953 B2 * 2/2005 Schell ..... H01R 13/055 439/825
6,881,102 B2 * 4/2005 Correll ..... H01R 13/428 439/752
6,890,221 B2 * 5/2005 Wagner ..... H01R 12/7088 439/65
7,001,189 B1 * 2/2006 McGowan ..... H01R 43/0256 439/79
7,037,142 B2 * 5/2006 Evans ..... H01R 13/44 439/633
7,059,892 B1 * 6/2006 Trout ..... H01R 13/5812 439/460
7,059,919 B2 * 6/2006 Clark ..... H01R 13/11 439/65

(Continued)

*Primary Examiner* — Ross Gushi
(74) *Attorney, Agent, or Firm* — Sughrue Mion, PLLC

(57) ABSTRACT

A power connector includes an insulative housing, a plurality of power contacts received in the insulative housing, a contact bus bar electrically connecting with the plurality of power contacts and a fastening element fastening the contact bus bar and an outer terminal arranged behind the insulative housing together. The insulative housing has a mating face at a front side thereof. The power contacts are provided with soldering pads, and the contact bus bar has a front mating pad engaging with the soldering pads. The front mating pad is formed with a plurality of soldering holes, and the front mating pad and the soldering pads being connected electrically via soldering tin set in the soldering holes.

13 Claims, 11 Drawing Sheets

(56) References Cited

U.S. PATENT DOCUMENTS 7,070,464 B2 * 7/2006 Clark ..... H01R 13/11 439/65
7,104,812 B1 * 9/2006 Bogiel ..... H01R 12/724 439/79
7,137,848 B1 * 11/2006 Trout ..... H01R 13/514 439/170
7,168,963 B2 * 1/2007 Minich ..... H01R 12/727 439/79
7,309,242 B2 * 12/2007 Clark ..... H01R 13/11 439/65
7,314,377 B2 * 1/2008 Northey ..... H01R 12/777 439/79
7,374,436 B2 * 5/2008 Schell ..... H01R 13/055 439/79
7,425,145 B2 * 9/2008 Ngo ..... H01R 12/7088 439/290
7,452,249 B2 * 11/2008 Daily ..... H01R 13/113 439/825
7,458,839 B2 * 12/2008 Ngo ..... H01R 12/7088 439/291
7,488,217 B2 * 2/2009 Cheng ..... H01R 13/11 439/668
7,488,222 B2 * 2/2009 Clark ..... H01R 13/11 439/65
7,666,025 B2 * 2/2010 Cheng ..... H01R 12/7088 439/374
RE41,283 E * 4/2010 Evans ..... H01R 13/44 439/633
7,690,937 B2 * 4/2010 Daily ..... H01R 13/113 439/290
7,726,982 B2 * 6/2010 Ngo ..... H01R 13/42 439/206
7,727,001 B2 * 6/2010 Percherke ..... H01R 12/712 439/378
7,762,857 B2 * 7/2010 Ngo ..... H01R 13/112 439/747
7,905,731 B2 * 3/2011 Ngo ..... H01R 12/585 439/75
7,976,317 B2 * 7/2011 Patel ..... H01R 12/7088 439/699.1
7,980,860 B2 * 7/2011 Yu ..... H01R 13/03 439/65
7,997,936 B2 * 8/2011 Yu ..... H01R 13/055 439/190
8,096,814 B2 * 1/2012 Schell ..... H01R 13/11 439/79
8,187,017 B2 * 5/2012 Daily ..... H01R 13/113 439/290
8,262,395 B2 * 9/2012 Ke ..... H01R 13/11 439/79
8,323,049 B2 * 12/2012 Ngo ..... H01R 13/6275 439/552
8,328,583 B2 * 12/2012 Yu ..... H01R 13/055 439/485
8,366,458 B2 * 2/2013 Ngo ..... H01R 12/724 439/79
8,414,336 B2 * 4/2013 Yu ..... H01R 4/30 439/660
8,419,476 B1 * 4/2013 Yu ..... H01R 24/20 439/540.1
8,419,477 B1 * 4/2013 Yu ..... H01R 25/162 439/540.1
8,435,043 B2 * 5/2013 Yu ..... H01R 12/7088 439/65
8,545,270 B2 * 10/2013 Yu ..... H01R 24/20 439/540.1
8,574,015 B2 * 11/2013 Tai ..... H01R 13/02 439/682
8,591,250 B2 * 11/2013 Chin ..... H01R 12/724 439/485
8,602,796 B2 * 12/2013 Chin ..... H01R 13/055 439/79
8,662,913 B2 * 3/2014 Tai ..... H01R 13/50 439/345
8,662,923 B2 * 3/2014 Wu ..... H01R 12/58 439/595
8,684,772 B2 * 4/2014 Yu ..... H01R 13/514 439/717
8,696,390 B2 * 4/2014 Tai ..... H01R 13/115 439/660
8,702,445 B2 * 4/2014 Yu ..... H01R 13/46 439/485
8,801,474 B2 * 8/2014 Rong ..... H01R 13/113 439/737
8,814,605 B2 * 8/2014 Yu ..... H01R 13/055 439/689
8,821,184 B2 * 9/2014 Yu ..... H01R 11/07 439/512
8,926,375 B2 * 1/2015 Chen ..... H01R 12/7088 439/682
8,932,082 B2 * 1/2015 Yu ..... H01R 13/428 439/626
8,968,009 B2 * 3/2015 Chen ..... H01R 12/7088 439/79
9,054,448 B2 * 6/2015 Yu ..... H01R 12/58
9,059,546 B2 * 6/2015 Yu ..... H01R 24/20
9,136,645 B1 * 9/2015 Yu ..... H01R 12/7088
9,153,887 B2 * 10/2015 Chen ..... H01R 12/7088
9,287,671 B1 * 3/2016 Chen ..... H01R 25/00
9,312,650 B1 * 4/2016 Chen ..... H01R 24/68
2003/0219999 A1 * 11/2003 Minich ..... H01R 12/727 439/79
2005/0042901 A1 * 2/2005 Minich ..... H01R 12/727 439/79
2006/0128197 A1 * 6/2006 McGowan ..... H01R 9/091 439/212
2006/0194481 A1 * 8/2006 Clark ..... H01R 13/11 439/825
2006/0228927 A1 * 10/2006 Daily ..... H01R 13/113 439/290
2006/0281354 A1 * 12/2006 Ngo ..... H01R 13/113 439/290
2007/0197063 A1 * 8/2007 Ngo ..... H01R 12/7088 439/108
2007/0202748 A1 * 8/2007 Daily ..... H01R 13/113 439/607.05
2007/0293084 A1 * 12/2007 Ngo ..... H01R 13/42 439/552
2008/0038956 A1 * 2/2008 Swain ..... H01R 12/716 439/487
2008/0214027 A1 * 9/2008 Schell ..... H01R 13/11 439/79
2008/0248670 A1 * 10/2008 Daily ..... H01R 13/113 439/290
2009/0088028 A1 * 4/2009 Ngo ..... H01R 13/432 439/682
2009/0142953 A1 * 6/2009 Patel ..... H01R 12/7088 439/345
2009/0197466 A1 * 8/2009 Cheng ..... H01R 12/7088 439/589
2010/0041266 A1 * 2/2010 Data ..... H01R 12/7088 439/358
2012/0164892 A1 * 6/2012 Ke ..... H01R 27/02 439/676
2012/0289071 A1 * 11/2012 Dodds ..... H01R 12/724 439/183
2013/0109224 A1 * 5/2013 Chin ..... H01R 12/7088 439/485
2014/0104781 A1 * 4/2014 Chen ..... H01R 12/7088 361/679.41
2014/0127949 A1 * 5/2014 Yu ..... H01R 12/58 439/660
2014/0141656 A1 * 5/2014 Chen ..... H01R 12/7088 439/682
2014/0206241 A1 * 7/2014 Chen ..... H01R 12/7088 439/676

* cited by examiner

POWER CONNECTOR

BACKGROUND

1. Technical Field

The present disclosure relates to an electrical connector, and more particularly to a power connector which can be produced and assembled easily.

2. Description of Related Art

A conventional power connector usually includes a plurality of power contacts and a housing receiving the power contacts. Each power contact has a mating portion electrically connecting with a complementary connector and a soldering portion connecting with a printed circuit board or a terminal device. Generally, the mating portions and the soldering portions are provided one-to-one correspondence. In other words, each mating portion connects with a respective soldering portion. However, when the conventional power connector is used in an environment needing high electric current, the power contacts of such conventional power connector are easier to be invalid, which in turn make troubles for users.

TW patent application no. 201405977 discloses a power connector, which connects a plurality of power contacts and a contact bus bar together by a number of screws and nuts. Therefore, the current in the contact bus bar is equal to the total current through all the power contacts. However, the plurality of screws and nuts not only increase cost, but also are assembled complicated.

It is desirable to provide an improved power connector and a method of making the same for solving above problems.

SUMMARY

In one aspect, the present invention includes a power connector. The power connector comprises an insulative housing, a plurality of power contacts received in the insulative housing, a contact bus bar electrically connecting with the plurality of power contacts and a fastening element fastening the contact bus bar and an outer terminal arranged behind the insulative housing together. The insulative housing has a mating face at a front side thereof. The power contacts are provided with soldering pads. The contact bus bar has a front mating pad engaging with the soldering pads. The front mating pad is formed with a plurality of soldering holes, and the front mating pad and the soldering pads being connected electrically via soldering tin set in the soldering holes.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE ILLUSTRATED EMBODIMENT

Figure 1:
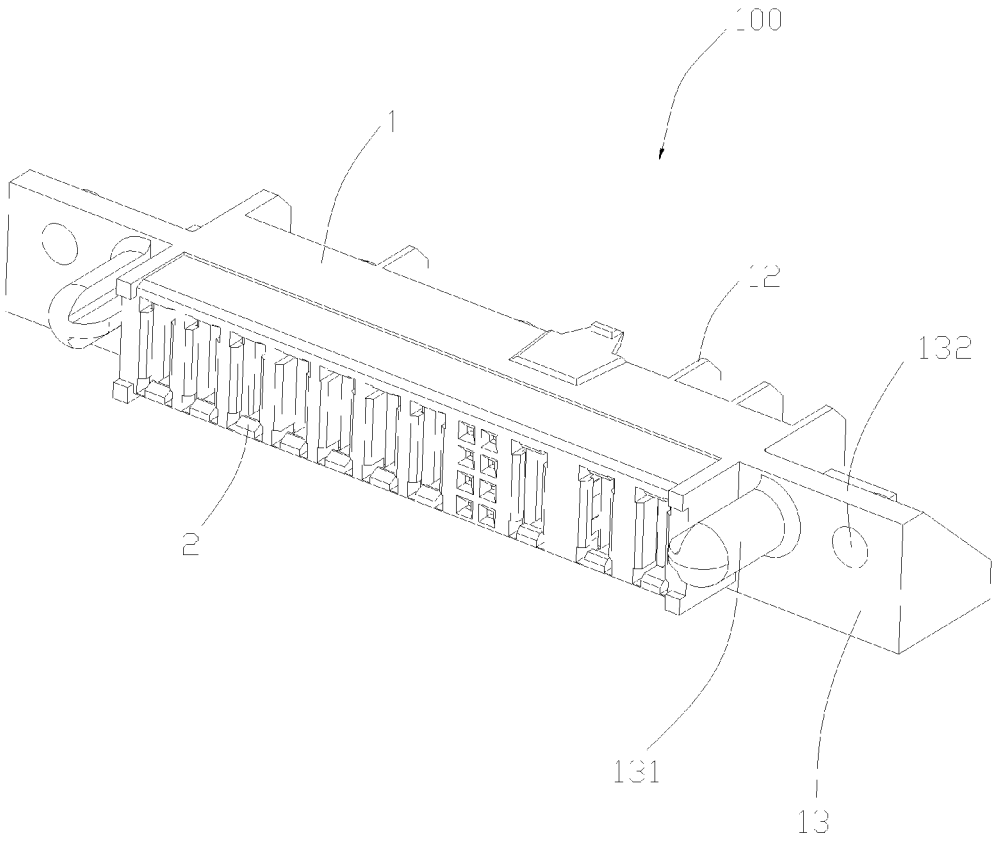
FIG. 1 is a perspective view illustrating a first embodiment of a power connector in the present disclosure.
Figure 2:
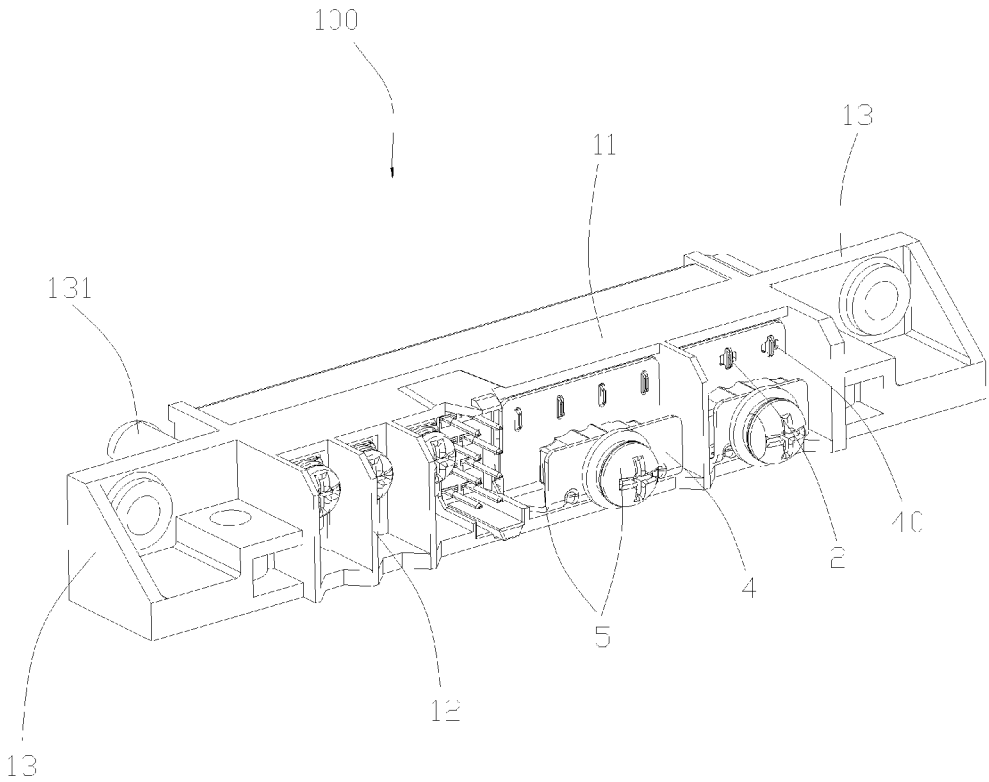
FIG. 2 is a view similar to FIG. 1, while viewed from another aspect.

Reference will now be made to the drawing figures to describe the embodiments of the present disclosure in detail. In the following description, the same drawing reference numerals are used for the same elements in different drawings.

Referring to FIGS. 1 to 5, a first preferred illustrated embodiment of the present disclosure discloses a power connector 100. The power connector 100 comprises an insulative housing 1, a plurality of power contacts 2 and signal contacts 3 accommodated in the insulative housing 1, two contact bus bars 4 and two fastening elements 5 mechanically and electrically fastening the contact bus bars 4 and two second outer terminals (not shown) together respectively.

Figure 3:
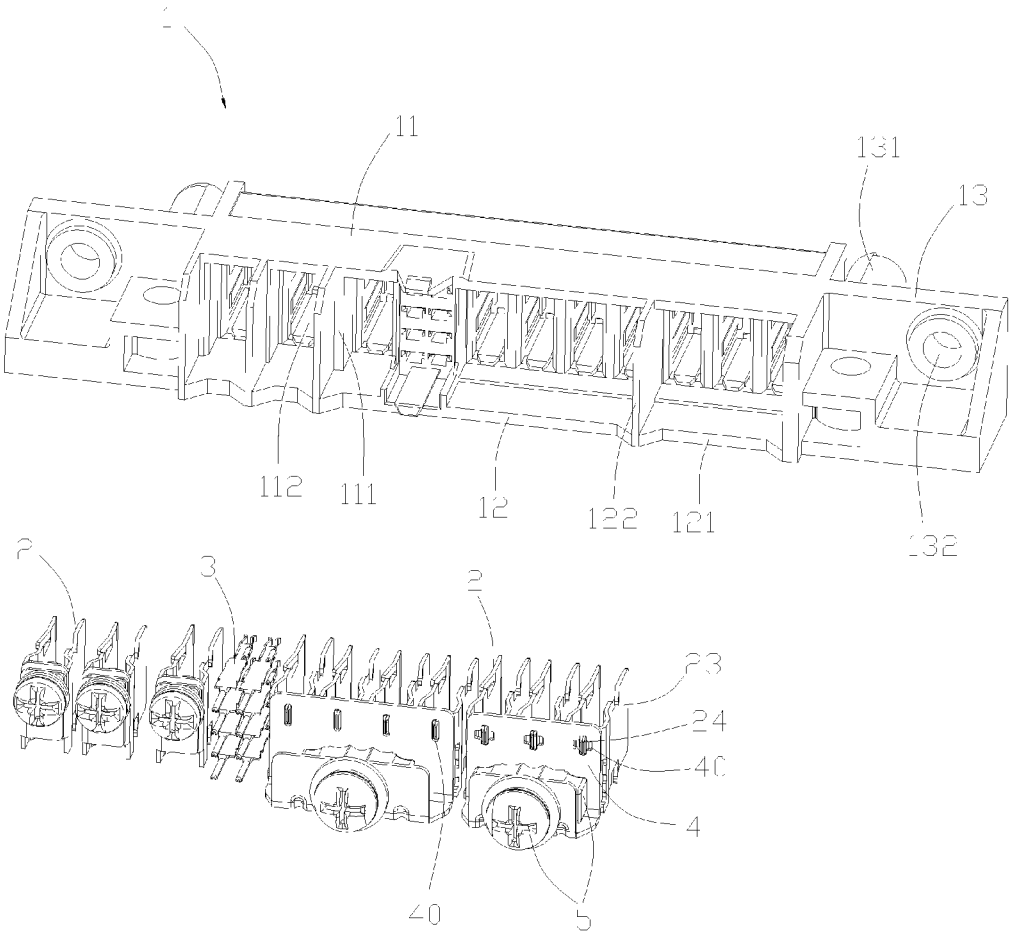
FIG. 3 is a partially exploded view of the power connector shown in FIG. 1.
Figure 4:
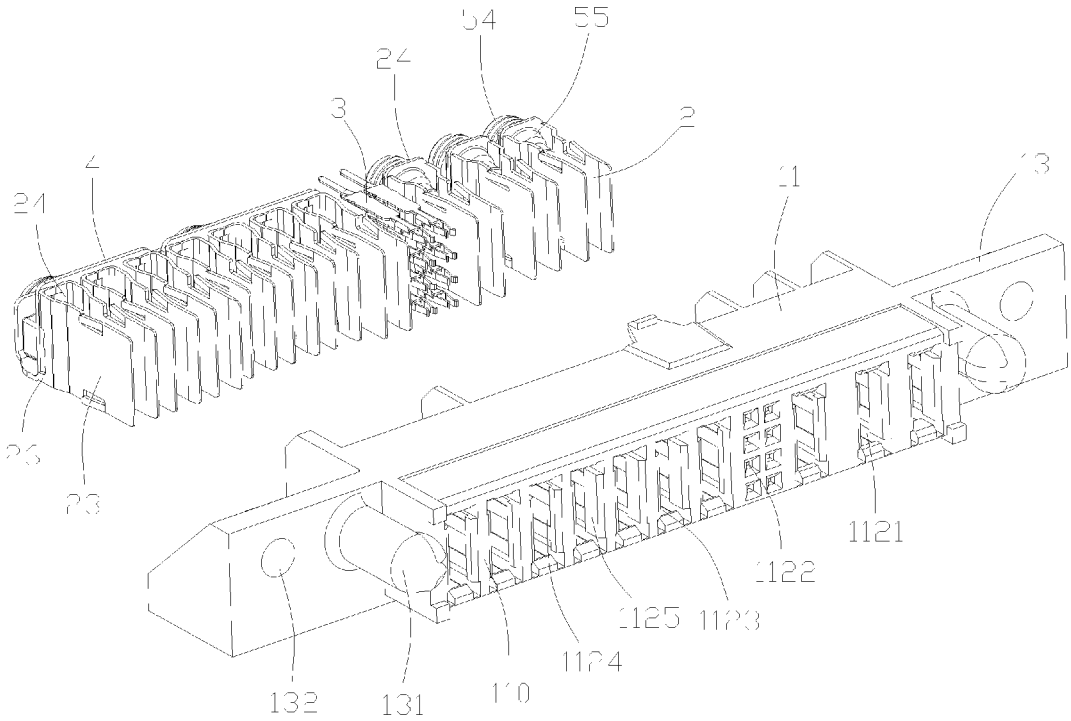
FIG. 4 is a view similar to FIG. 3, while viewed from another aspect.

Please refer together to FIGS. 3-4, the insulative housing 1 comprises a main portion 11, a bearing portion 12 backwardly extending from the main portion 11 and two side portions 13 located at two sides of the main portion 11. The side portion 13 is provided with a guide pole 131 which is close to the main portion 11 and a fixing hole 132 far from the main portion 11. The guide pole 131 is used to guide a mating connector inserting into the power connector 100, and the fixing hole 132 is used to fix the power connector 100 to an electronic device (not shown).

The main portion 11 has a mating face 110 at a front side thereof, a mounting face 111 at a rear side thereof and a plurality of receiving slots 112 extending through the mating face 110 and mounting face 111 along a front to back direction. In the present embodiment, the receiving slots 112 comprise a plurality of power contact slots 1121 and a plurality of signal contact slots 1122. The power contact slots 1121 are arranged along a transverse direction of the insulative housing 1. The signal contact slots 1122 are located between the power contact slots 1121.

Each power contact slot 1121 has a middle slot 1123 for receiving a mating contact and two position slots 1124 at two sides of the middle slot 1123. The position slots 1124 is wider than the middle slot 1123 along a top to bottom direction, and the position slots 1124 are formed with stop blocks 1125 at a front side thereof. The stop blocks 1125 prevent the power contacts 2 from moving forwardly. The bearing portion 12 comprises a bottom wall 121 backwardly extending from a bottom side of the main portion 11 and a plurality of clapboards 122 backwardly extending from the mounting face 111. The clapboards 122 are perpendicular to the bottom wall 121, and the bottom wall 121 connects the bottom ends of the clapboards 122.

Please refer together to FIGS. 1-5, each power contact slot 1121 is arranged with a pair of power contacts 2. There are ten power contact slots 1121 corresponding to ten pairs of the power contacts 2 in the present invention. Each pair of the power contacts 2 comprises a first contact 21 and a second contact 22. Each power contact 2 is provided with a contacting pad 23 and a first supporting portion 24 bending from the rear end of the contacting pad 23. The contacting pads 23 of the first and second contacts 21, 22 are parallel and confront to each other. The first supporting portions 24 of the first and second contacts 21, 22 extend toward each other along the transverse direction. The contacting pads 23 of the first and second contacts 21, 22 are received in the position slots 1124, and each contacting pad 23 is designed with a pair of resisting tabs 231 at upper and lower edges thereof. The position slots 1124 are formed with limited blocks (not shown) at a rear side of the resisting tabs 231. The resisting tabs 231 resist the limited blocks to prevent the power contacts 2 from moving backwardly. The contacting pads 23 abut against a rear side of the stop blocks 1125 to limit the power contacts 2 from moving forwardly.

In the present embodiment, the power contacts 2 are arranged in three groups which comprise a first group, a second group and a third group. Each of the first and third group comprises three pairs of power contacts 2. The second group is located between the first and third groups and comprises four pairs of power contacts 2. The power contacts 2 in the first group are different from the power contacts 2 in the second and third groups. The power contacts 2 in the second and third groups are similar, thereby the power contacts 2 in the third group will be chose to be illustrated in detail hereinafter, and the second group will be omitted. In an alternative embodiment, the power contacts 2 in first group can be designed similar to that in the third group.

Please refer FIGS. 3 and 4, in the first group, the first and second contacts 21, 22 of each pair of the power contacts 2 connect with each other respectively, thus the current transmitted in each power contact slot 1121 is equal to the total current through each pair of the power contacts 2 respectively. Specifically, the first supporting portions 24 of each pair of the power contacts 2 in the first group overlap each other and are provided with fixing holes (not shown), and each pair of the power contacts 2 is fixed with a first outer terminal by a screw 54, a nut 55 and the fixing holes.

Figure 5:
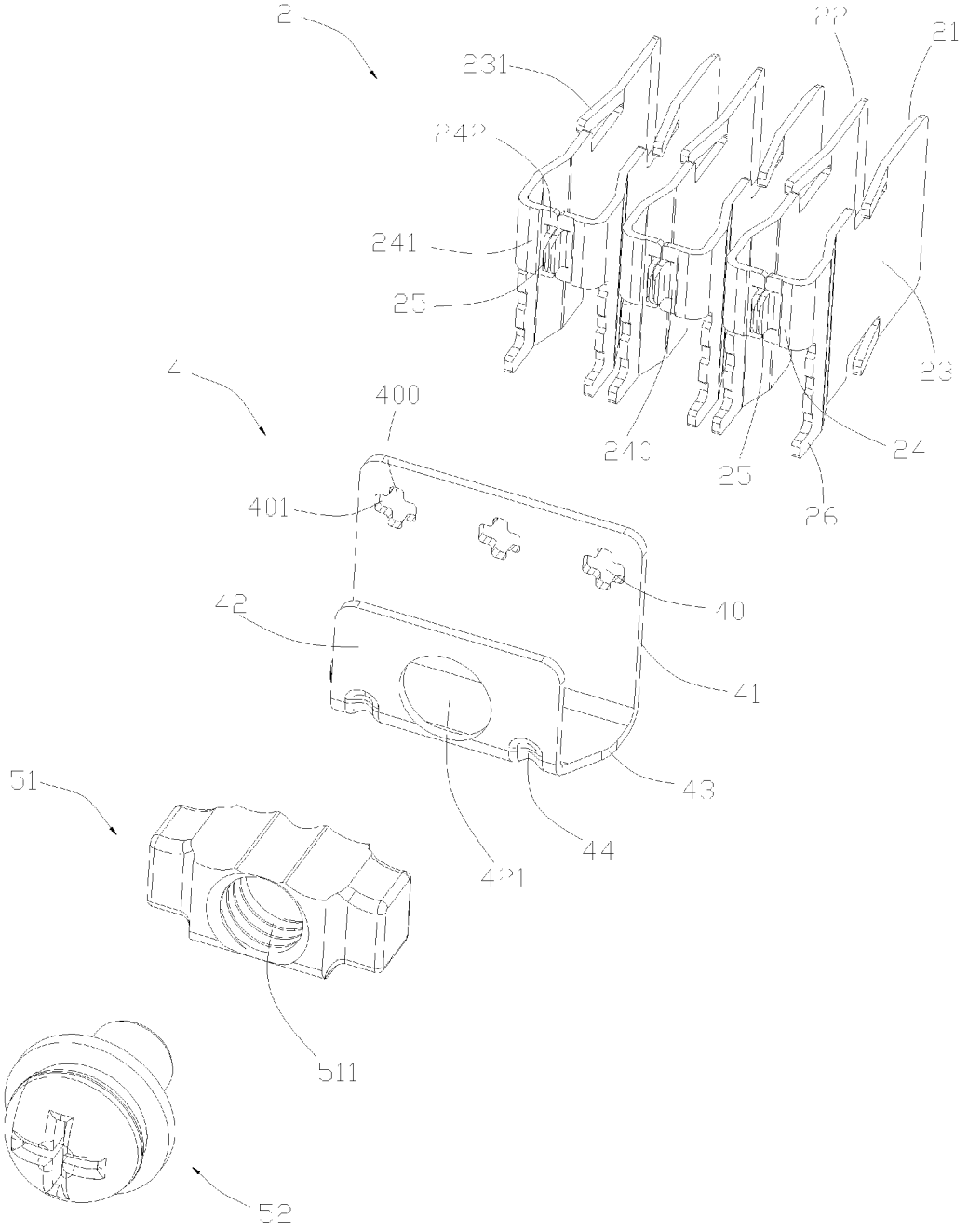
FIG. 5 is an exploded view of the power contact, contact bus bar and fastening element of the power connector shown in FIG. 3.

Please refer FIGS. 3-5, for transmitting high current, the power contacts 2 in the second and third group connect in parallel by one contact bus bar 4 respectively. Therefore, the power contacts 2 in the second or third group can connect with the second outer terminal by the contact bus bar 4, therefore the current in the second outer terminal is equal to the total current through all power contacts 2 in the second or third group.

For example, referring to FIG. 5, each power contact 2 in the third group further has a soldering pad 25 bending from the first supporting portion 25. The contact bus bar 4 is designed with a front mating pad 41 connecting with the soldering pads 25, a rear pad 42 opposite to the front mating pad 41 and a bridge 43 interconnecting the lower ends of the front mating pad 41 and the rear pad 42. The rear pad 42 connects with the second outer terminal. The front mating pad 41 and the rear pad 42 extend along the bottom-to-top direction and are parallel to each other. Taking the bridge 43 as a reference, the front mating pad 41 is higher than the rear pad 42. The bridge 43 is supported by the bottom wall 121 of the bearing portion 12. The front mating pad 41 is formed with a plurality of soldering holes 40, and the front mating pad 41 and the soldering pads 25 are connected electrically via soldering tin set in the soldering holes 40.

In detail, referring to FIG. 5, the first supporting portions 24 in the third group are parallel to the front mating pad 41. The first supporting portions 24 of each pair of the power contacts 2 in the third group are located at a common plane and abut against the front mating pad 41. The soldering pads 25 of each pair of the power contacts 2 bends from adjacent ends of the supporting portions 24 and abut against each other face to face. Then the soldering pads 25 of each pair of the power contacts 2 are perpendicular to the front mating pad 41 and commonly received in a same soldering hole 40.

Referring to the configuration of the contact has bur 4 which connects with the power contacts 2 of the second group shown in FIG. 3, the soldering hole 40 presents as a shape corresponding to the combined shape of the soldering pads 25 of each pair of the power contacts 2. Alternatively, referring to the configuration of the contact has bur 4 which connects with the power contacts 2 of the third group shown in FIG. 5, the soldering hole 40 is provided with a main hole 400 and two extension holes 401 extending outwardly from two sides of the main hole 400. The main hole 400 presents as a shape corresponding to the combined shape of the soldering pads 25 of each pair of the power contacts 2 to receive the soldering pads 25. The extension holes 401 are the expansion of the main holes 400 for increasing soldering tin and strengthening the connection between the power contacts 2 and the contact bas bur 4. Besides, the first supporting portion 24 further defines a recess 240 around the soldering pad 25 for receiving soldering tin and further strengthening the connection between the power contacts 2 and the contact bas bur 4.

The soldering pad 25 is narrower than the first supporting portion 24. The first supporting portion 24 is provided with a base portion 241 and at least an extension portion 242 extending from the base portion 241. The soldering pad 25 bends from the base portion 241 and is parallel to the contacting pad 23. In the transverse direction of the insulative housing 1, the base portion 241 is located at outside of the soldering pad 25. The contacting pad 23 defines a width direction which is perpendicular to the transverse direction, and in the width direction of the contacting pad 23, the extension portion 242 is adjacent to the soldering pad 25.

Please refer FIG. 5, in the first embodiment, the soldering pad 25 bends from a middle position of the base portion 241. Each first supporting portion 24 is provided with two extension portions 242 at two sides of the soldering pad 25 along the width direction of the contacting pad 23. The soldering pad 25 and the free ends of the extension portions 242 are located at a common plane. Thereby the extension portions 242 of the power contacts 2 in each receiving slot 112 abut against each other too.

Besides, each power contact 2 in the third group is further provided with a second supporting portion 26 extending toward the front mating pad 41 from the contacting pad 23. The second supporting portion 26 is perpendicular to and abuts against the front mating pad 41. The first supporting portion 24 and the second supporting portion 26 extend from two sides of the rear end of the contacting pad 23, which can supply a stable position between the power contacts 2 and the contact bus bar 4. The second supporting portion 26 is close to the bridge 43, and the first supporting portion 24 is far from the bridge 43, then the fastening element 5 can be conveniently arranged on the contact bus bar 4 to connect the contact bus bar 4 and the outer terminal together easily. In the present embodiment, the first supporting portion 24 and the second supporting portion 26 space apart from each other along the width direction of the contacting pad 23. Of course, the first supporting portion 24 and the second supporting portion 26 can be alternatively designed to be adjacent to each other.

Please refer FIGS. 3-5, each fastening element 5 comprises a positioning nut 51 and a screw 52 for interconnecting the contact bus bar 4 and the second outer terminal. The rear pad 42 defines a positioning hole 421. The positioning nut 51 is positioned between the front mating pad 41 and the rear pad 42, and defines a screw hole 511 corresponding to the positioning hole 421. The contact bus bar 4 is formed with a plurality of protrusions 44 to fix the positioning nut 51 between the front mating pad 41 and the rear pad 42. The protrusions 44 protrude from the bridge 43. The screw 52 extends through the positioning hole 421 and matches with the screw hole 511 to fix the second outer terminal and the rear pad 42 together.

As described above, the soldering pads 24 of the power contacts 2 in the second and third groups electrically connect with the contact bas bars 4 via soldering tin set in the soldering holes 40, that make the power connector 100 have a simple structure, be assembled easily and have a lower cost.

Figure 6:
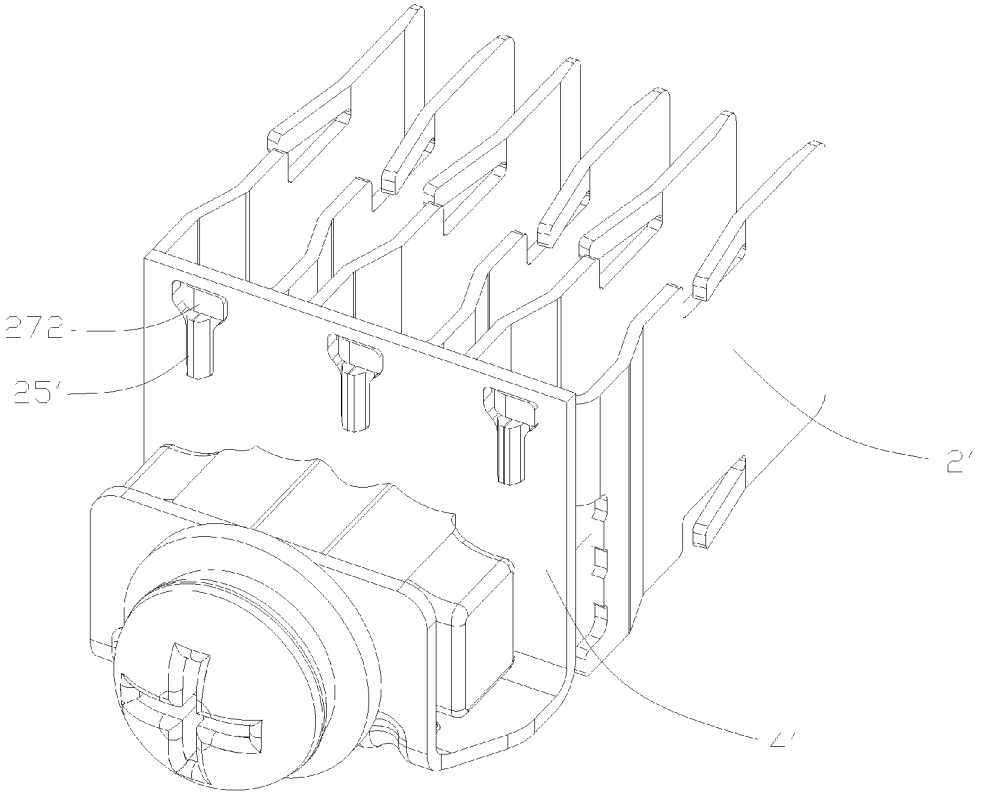
FIG. 6 is a perspective view illustrating a second embodiment of the power contact, contact bus and fastening element of the power connector.
Figure 7:
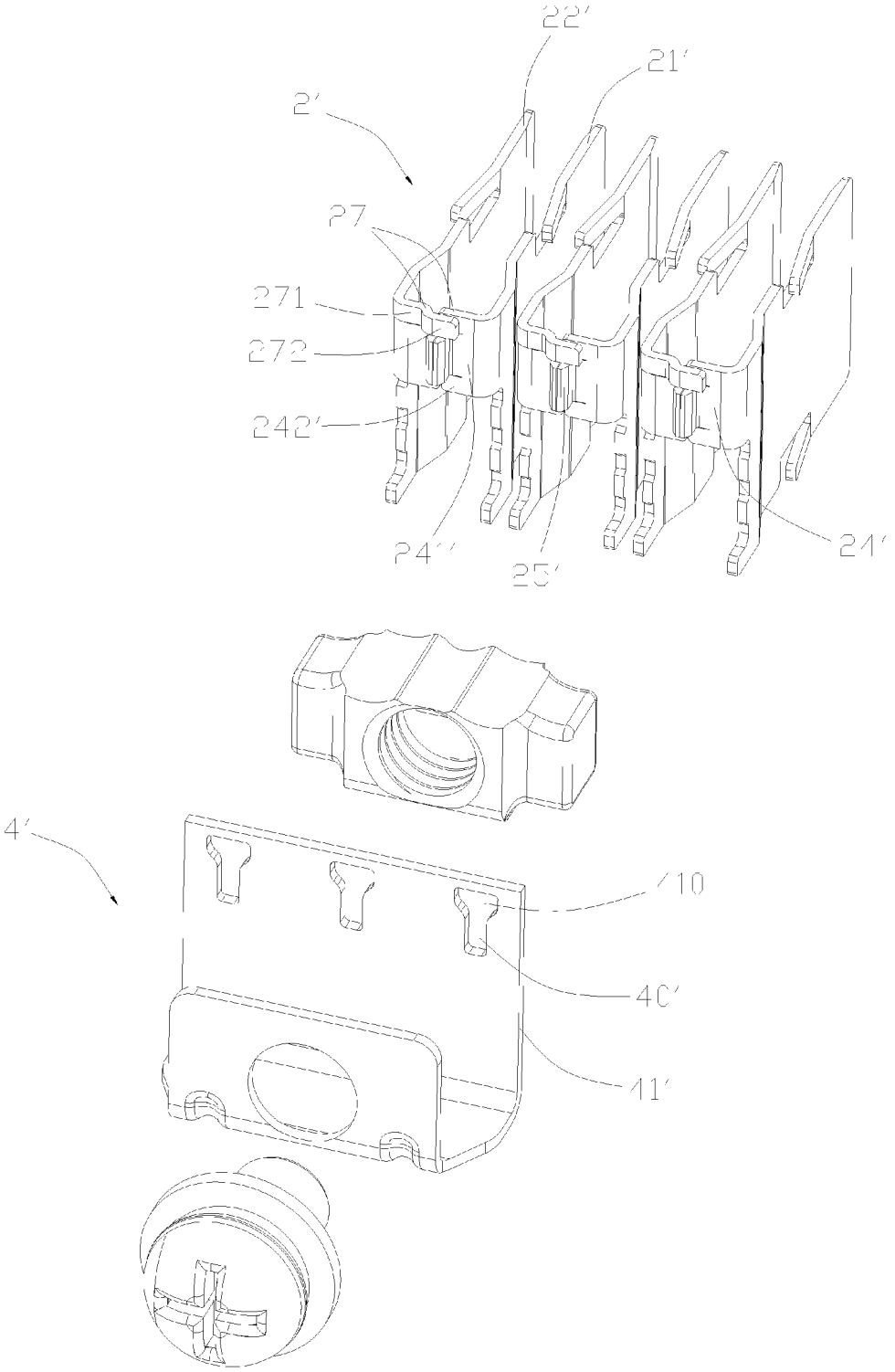
FIG. 7 is an exploded view of the power contact, contact bus bar and fastening element of the power connector shown in FIG. 6.

Please refer FIGS. 6 and 7, in a second embodiment of the present invention, the matching construction between the contact bas bar 4' and the power contacts 2' in the second and third groups is different from that in the first embodiment. Same to that in the first embodiment, the power contacts 2' in the second and third groups are similar, thereby the power contacts 2' in the third group will be chose to be illustrated in detail hereinafter, and the second group will be omitted.

In detail, each first supporting portion 24' of the power contact 2' in the third group is provided with only one extension portion 242' at one side of the soldering pad 25'. Besides, each power contact 2' in the third group further has a limit portion 27 located at another side of the soldering pad 25'. The soldering pad 25' and the free end of the extension portions 242' of each power contact 2' are located at a common plane, which make the extension portions 242' of each pair of the power contacts 2' abut against each other. The limit portion 27 extends beyond the soldering pad 25' along the transverse direction, which can limit the soldering pad 25' from moving along the width direction of the contacting pad 23', and is convenient to position the soldering pads 25' of each pair of the power contacts 2'. The limit portion 27 and the first supporting portion 24' of the first contact 21' are located at another common plane, while the limit portion 27 of the second contact 22' laps over the limit portion 27 of the first contact 21'. The front mating pad 41' further defines a plurality of limit holes 410 to receive the limit portions 27 of the second contacts 22'. The limit holes 410 communicate with the soldering holes 40'. The combination of the limit hole 410 and the soldering hole 40' presents as T-shape.

Please refer to FIG. 7, the limit portion 27 of the second contact 22' has a lateral portion 271 and a lap portion 272 bending from the lateral portion 271. The lateral portion 271 is adjacent to the base portion 241' of the first supporting portion 24', and is located at a common plane with the base portion 241'. The lap portion 272 laps over the limit portion 27 of the first contact 21'. The lateral portion 271 and the base portion 241' abut against the front mating pad 41'. The lap portion 272 is received in the limit hole 410.

Figure 8:
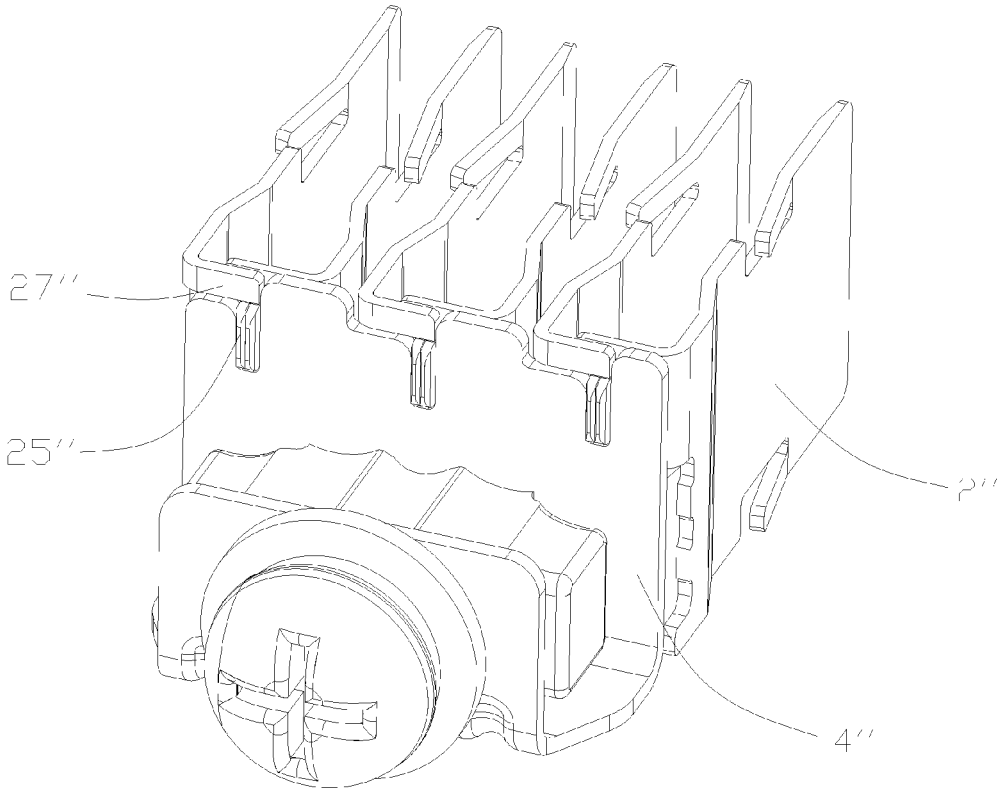
FIG. 8 is a perspective view illustrating a third embodiment of the power contact, contact bus and fastening element of the power connector.
Figure 9:
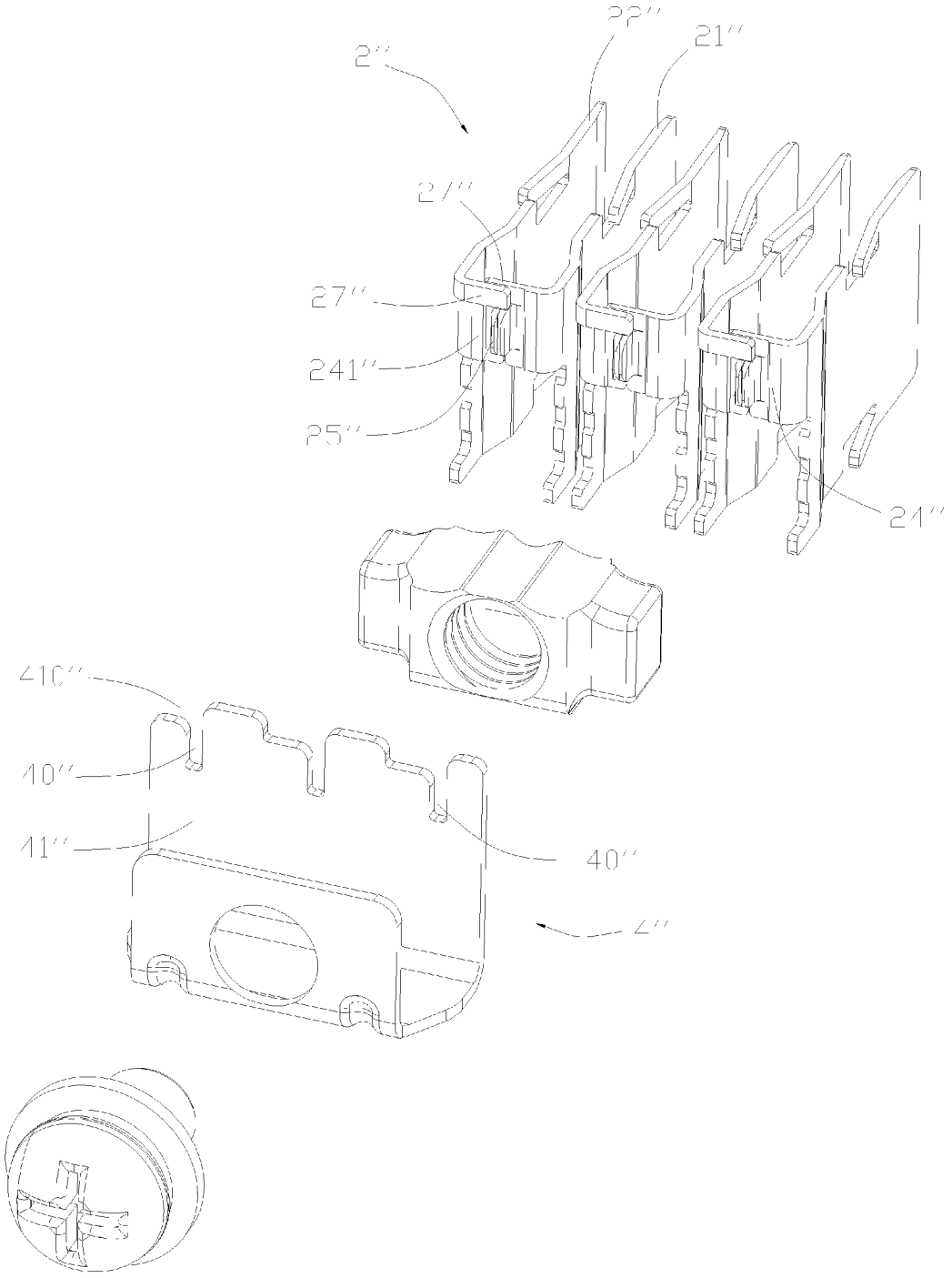
FIG. 9 is an exploded view of the power contact, contact bus bar and fastening element of the power connector shown in FIG. 8.

FIGS. 8 and 9 illustrates an overview of a group of power contacts 2", a contact bus 4" and a fastening element according to a third embodiment. In FIGS. 8 and 9, the same elements as those of FIGS. 6 and 7 are referred to by the same characters, and a description thereof is omitted.

In the third embodiment, the whole limit portion 27" of the second contact 22" in each pair of the power contacts 2" is located in a same plane, and the limit portion 27" of the second contacts 22" and the base portion 241" are arranged on different planes. The limit portion 27" of the second contact 22" laps over the limit portion 27" of the first contact 21". Besides, the whole limit portion 27" of the second contact 22" is received in the limit hole 410". The combination of the limit hole 410" and the soldering hole 40" present as 7-shape.

Figure 10:
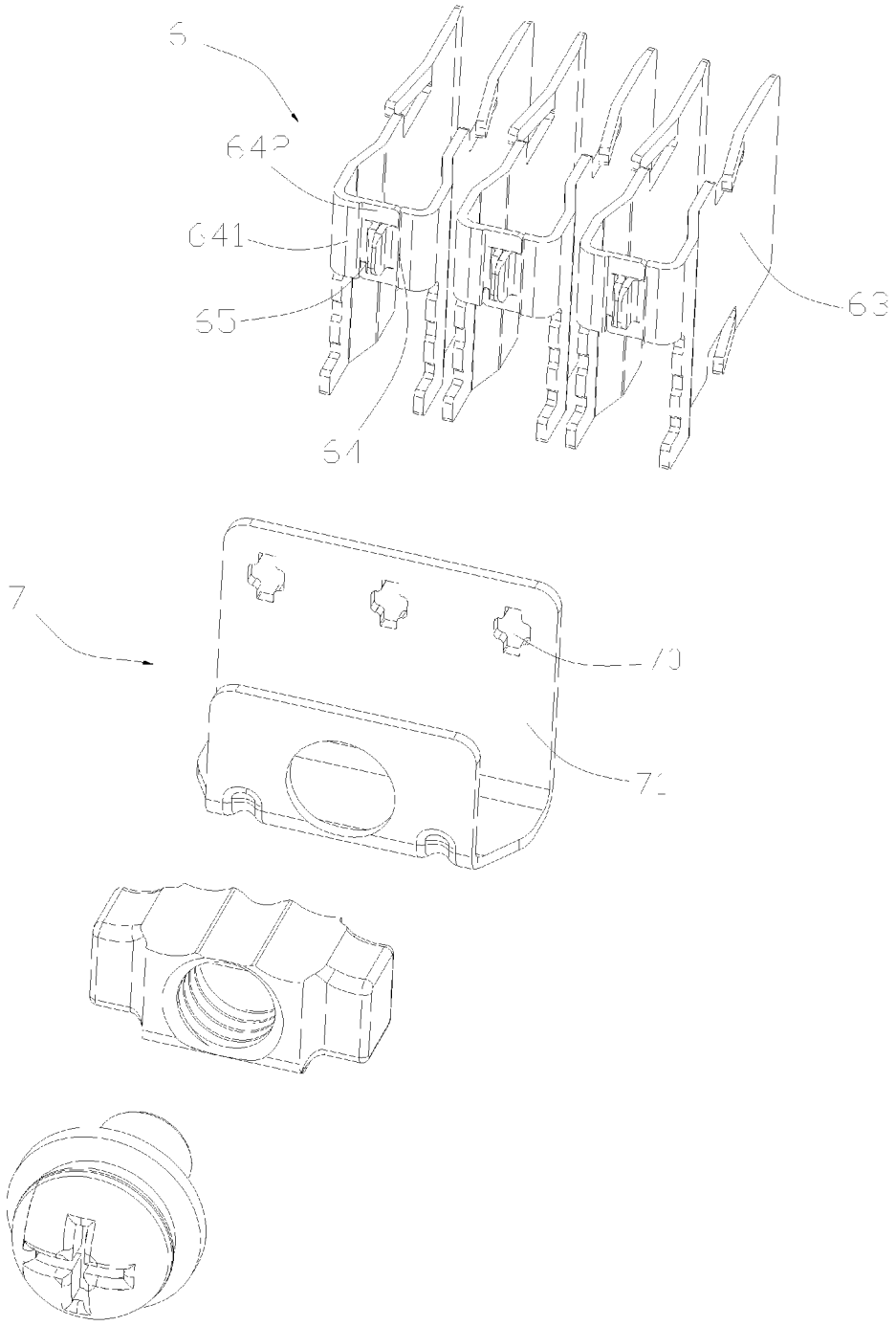
FIG. 10 is an exploded view illustrating a fourth embodiment of the power contact, contact bus and fastening element of the power connector.

FIG. 10 illustrates an overview of a group of power contacts 6, a contact bus 7 and a fastening element according to a fourth embodiment. In FIG. 10, the same elements as those of FIGS. 1-5 are referred to by the same characters, and a description thereof is omitted.

In the fourth embodiment, each first supporting portion 64 of the power contacts 6 in the third group is provided with only one extension portion 642. The extension portion 642 extends beyond the soldering pad 65 along the transverse direction, and the extension portions 642 of each pair of the power contacts 6 are located at different sides of the soldering pads 65 and stagger to each other. In each pair of the power contacts 6, the extension portion 642 of one power contact 6 resists opposite end surface of the base portion 641 of another power contact 6. Thus the extension portion 642 of one power contact 6 can limit the soldering pad 65 of another power contact 6 from moving along the width direction of the contacting pad 63.

Figure 11:
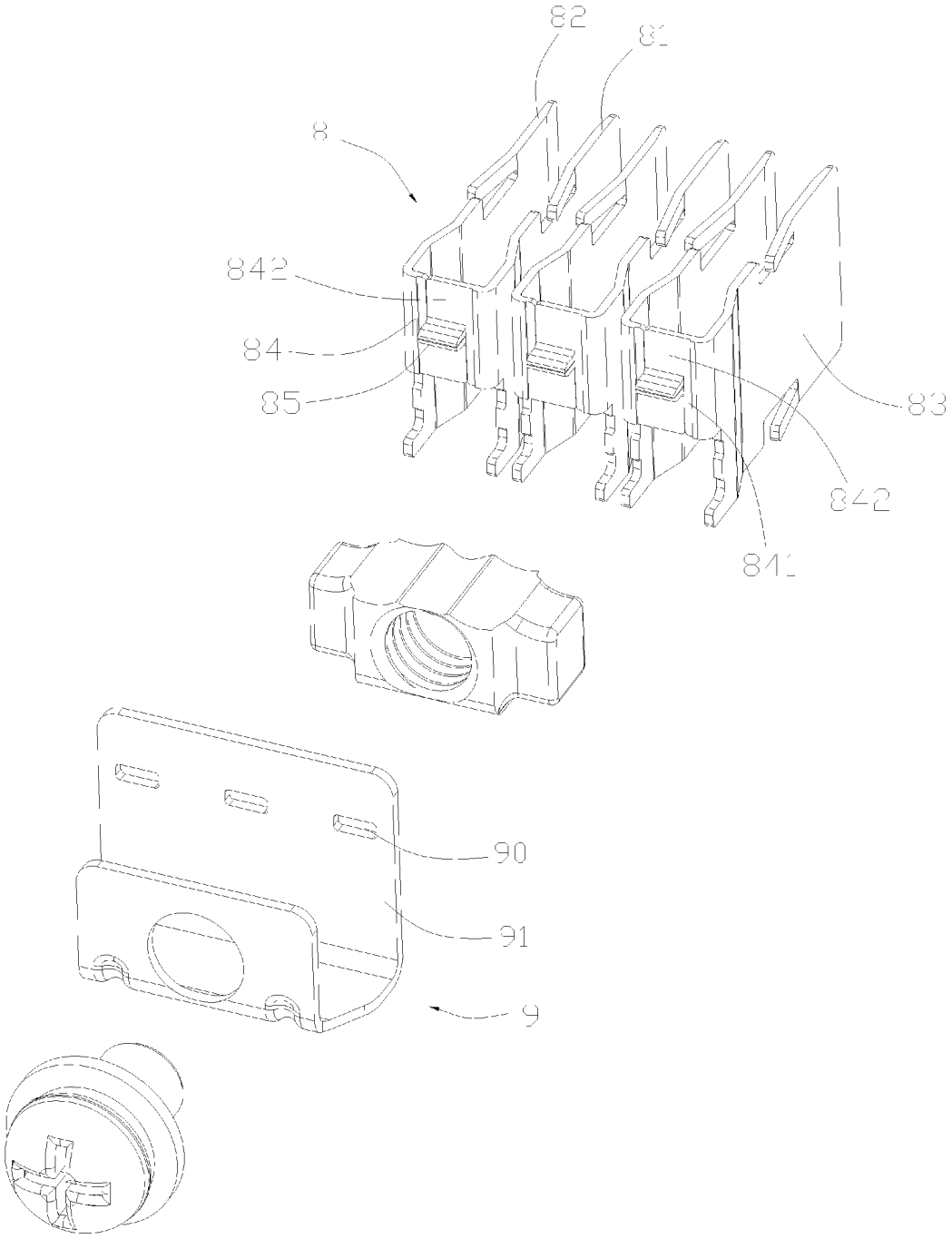
FIG. 11 is an exploded view illustrating a fifth embodiment of the power contact, contact bus and fastening element of the power connector.

FIG. 11 illustrates an overview of a group of power contacts 8, a contact bus 9 and a fastening element according to a fifth embodiment. In FIG. 11, the same elements as those of FIGS. 1-5 are referred to by the same characters, and a description thereof is omitted.

In the fifth embodiment, each first supporting portion 84 is provided with a base portion 841 and an extension portion 842 extending from the base portion 841. The soldering pads 85 of the power contacts 8 bend from the extension portions 842 and are perpendicular to the contacting pads 83. In the transverse direction, the base portion 841 is located at outside of the soldering pad 85. In each pair of the power contacts 8, the extension portion 842 of one power contact 8 resists opposite end surface of the base portion 841 of another power contact 8. Besides, the soldering pad 85 has a width same to that of the extension portion 842.

According to above illustration of the power connector 100, the present invention further discloses a method of making the power connector 100. The method comprises: first, providing a plurality of power contacts 2, 2', 2", 6, 8 and an insulative housing 1, and fixing the power contacts 2, 2', 2", 6, 8 to the insulative housing 1, the power contacts 2, 2', 2", 6, 8 being provided with soldering pad 25, 25', 25", 65, 85; secondly, providing a contact bus bar 4, 4', 4", 7, 9 and a fastening element 5, and fastening the contact bus bar 4, 4', 4", 7, 9 and an outer terminal together via the fastening element 5, the contact bus bar 4, 4', 4", 7, 9 having a front mating pad 41, 41', 41", 71, 91 to engage with the power contacts 2, 2', 2", 6, 8, and the front mating pad 41, 41', 41", 71, 91 being formed with soldering hole 40, 40', 40", 70, 90; thirdly, fixing the contact bus bar 4, 4', 4", 7, 9, the fastening element 5 and the second outer terminal to a rear side of the insulative housing 1 and enabling the front mating pad 41, 41', 41", 71, 91 of the contact bus bar 4, 4', 4", 7, 9 abut against the first supporting portions 24, 24', 24", 64, 84; finally, welding the soldering pads 25, 25', 25", 65, 85 of the power contacts 2, 2', 2", 6, 8 and the front mating pad 41, 41', 41", 71, 91 at the position of the soldering hole 40, 40', 40", 70, 90 via soldering tin.

The contact bus bar 4, 4', 4", 7, 9, the fastening element 5 and the outer terminal are supported by the bottom wall 121 and clapboards 122. Besides, the contact bus bar 4, 4', 4", 7, 9 is further positioned by the engagement between soldering pads 25, 25', 25", 65, 85 and the soldering holes 40, 40', 40", 70, 90 designed on the front mating pad 41', 71, 91, that enable the welding connection between the power contacts 2, 2', 2", 6, 8 and the contact bus bar 4, 4', 4", 7, 9 more conveniently, and the contact area is increased by the contact between the first supporting portion 24, 24', 24", 64, 84 and the front mating pad 41, 41', 41", 71, 91.

As described above, the electrical connection between the contact bus bar 4, 4', 4", 7, 9 and the power contacts 2, 2', 2", 6, 8 can be realized by the soldering holes 40, 40', 40", 70, 90 and soldering tin, that can make the power connector 100 be produced and assembled easier. Besides, the structure of the power connector 100 can avoid many position elements, hence the cost for making the power connector 100 is down too.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. A power connector, comprising:

an insulative housing having a mating face at a front side thereof;

a plurality of power contacts received in the insulative housing;

a contact bus bar electrically connecting with the plurality of power contacts;

a fastening element fastening the contact bus bar and an outer terminal arranged behind the insulative housing together;

wherein the power contacts are provided with soldering pads, and the contact bus bar has a front mating pad engaging with the soldering pads, the front mating pad is formed with a plurality of soldering holes, and the front mating pad and the soldering pads being connected electrically via soldering tin set in the soldering holes.

2. The power connector as claimed in claim 1, wherein the power contact is formed with a contacting pad and a first supporting portion bending from the contacting pad, the first supporting portion is parallel to and abuts against the front mating pad, and the soldering pad bends from the first supporting portion and is received in the soldering hole.

3. The power connector as claimed in claim 2, wherein the power contact further has a second supporting portion extending toward the front mating pad, the second supporting portion is perpendicular to and abuts against the front mating pad, and the first supporting portion and the second supporting portion extend from two sides of the contacting pad.

4. The power connector as claimed in claim 2, wherein the insulative housing defines a plurality of receiving slots, the power contacts are received in the receiving slot in pairs, the soldering pads of the power contacts in each receiving slots are parallel to each other and received in a common soldering hole.

5. The power connector as claimed in claim 4, wherein the soldering pads abut against each other face to face, the soldering hole has a main hole and two extension holes extending outwardly from two sides of the main hole, the soldering pads are received in the main hole.

6. The power connector as claimed in claim 4, wherein the soldering pad is narrower than the first supporting portion, the first supporting portion is provided with a base portion and at least an extension portion extending from the base portion, the soldering pad bends from the base portion and is parallel to the contacting pad, the base portion is located at outside of the soldering pad in a transverse direction of the insulative housing, the extension portion is adjacent to the soldering pad in a width direction of the contacting pad.

7. The power connector as claimed in claim 6, wherein each first supporting portion is provided with two extension portions at two sides of the soldering pad, and the soldering pad and the free ends of the extension portions are located at a common plane, which make the extension portions of the power contacts in each receiving slot abut against each other.

8. The power connector as claimed in claim 6, wherein each first supporting portion is provided with one extension portion at one side of the soldering pad, each power contact further has a limit portion located at another side of the soldering pad, and the soldering pad and the free ends of the extension portions are located at a common plane, which make the extension portions of the power contacts in each receiving slot abut against each other, the limit portion and the first supporting portion of one power contact in each receiving slot are located at another common plane, while the limit portion of another power contact in each receiving slot laps over the limit portion of said one power contact, the front mating pad defines a limit hole to receive the limit portion of said another power contact.

9. The power connector as claimed in claim 8, wherein the limit hole communicates with the soldering hole.

10. The power connector as claimed in claim 6, wherein each first supporting portion is provided with one extension portion at one side of the soldering pad, and the extension portion extends beyond the soldering pad, the extension portions of the power contacts in each receiving slot are stagger to each other, and the extension portion of one power contact in each receiving slot resist opposite end surface of the base portion of another power contact in the receiving slot.

11. The power connector as claimed in claim 4, wherein the first supporting portion is provided with a base portion and an extension portion extending from the base portion, the soldering pad bends from the extension portion and is perpendicular to the contacting pad, in a transverse direction of the insulative housing, the base portion is located at outside of the soldering pad, the extension portion of one power contact in each receiving slot resists opposite end surface of the base portion of another power contact in the receiving slot.

12. The power connector as claimed in claim 11, wherein the soldering pad has a width same to that of the extension portion.

13. The power connector as claimed in claim 2, wherein the first supporting portion defines a recess around the soldering pad for receiving soldering tin.

* * * * *